United States Patent [19]

Pekau et al.

[11] 4,029,960

[45] June 14, 1977

[54] DEVICE FOR THE RECORDING AND REPRODUCTION OF X-RAY PICTURES

[75] Inventors: Dietlind Pekau, Taufkirchen; Eckhard Storck, Munich, both of Germany

[73] Assignee: Siemens Aktiengesellschaft, Berlin & Munich, Germany

[22] Filed: Sept. 4, 1975

[21] Appl. No.: 610,161

[30] Foreign Application Priority Data

Sept. 6, 1974 Germany ..... 2442808

[52] U.S. Cl. ..... 250/315 R; 250/316

[51] Int. Cl.[2] ..... G03G 13/00; G03G 15/00

[58] Field of Search ..... 250/315, 315 A, 316, 250/317, 318, 326

[56] References Cited

UNITED STATES PATENTS

| | | | |
|---|---|---|---|
| 3,329,500 | 7/1967 | Goffe | 250/315 |
| 3,653,890 | 4/1972 | Seimiya | 250/315 |

*Primary Examiner*—Alfred E. Smith

*Assistant Examiner*—B. C. Anderson

*Attorney, Agent, or Firm*—Hill, Gross, Simpson, Van Santen, Steadman, Chiara & Simpson

[57] ABSTRACT

A device for the recording and reproduction of X-ray pictures utilizing a layer of amorphous selenium which is disposed in a housing, the selenium being carried by a thermoplastic layer, preferably having a further dielectric reflective layer interposed between the selenium and the thermoplastic layers, with an electrode being disposed at the other side of the selenium layer on the free surface thereof, at which side the X-ray beam impacts the device. The recorded structure may be read-out by the use of a schlieren or phase-contrast optic which is disposed to receive optical radiation reflected from the recorded structure, with the optical radiation being directed on the structure by a partially transmissive reflector disposed between such recorded structure and said optics, whereby reflected light from the structure may pass through the reflector to said optics, and focused, for example, on a viewing screen.

9 Claims, 2 Drawing Figures

DEVICE FOR THE RECORDING AND REPRODUCTION OF X-RAY PICTURES

BACKGROUND OF THE INVENTION

The invention relates to a device for the recording and reproduction of X-ray pictures, employing a layer of amorphous selenium which is disposed in a suitable housing.

To improve the picture quality and contrast of a recording of X-ray pictures, in comparison to the conventional photographic plates, it is already known to utilize the so-called "xero-radiography" process in which the X-rays hit a layer of amorphous selenium having a high dark resistance which is already charged prior to the exposure. The X-ray quanta produce high-speed photo-electrons in the selenium which, in turn, produce electron-hole pairs, as result of which a breaking down of charge occurs. Such layer is developed by dusting with a cloud of powder, for example, consisting of toner particles, whereupon the toner image is transferred by an electric field to an applied paper and is fixed by suitable thermal treatment.

It will be apparent from such a complicated development process that only low image production rates can be achieved and a radioscopic process in the form of series investigations is out of the question.

BRIEF SUMMARY OF THE INVENTION

The invention has as its objective, the production of a device for the recording and reproduction of X-ray pictures with high contrast, by means of which high image rates can be achieved, whereby the device is also suitable for radioscopic series investigations.

This objective is realized in the invention, in conjunction with the use of a layer of amorphous selenium disposed in such a housing, by the provision of a thermoplastic layer at one side of the selenium layer, with an electrode being disposed on the free surface of the opposite side of such layer. Preferably, an additional dielectric reflector is disposed between the thermoplastic layer and the selenium layer.

In a specific exemplary embodiment, an additional movable corona-charge electrode is provided which is disposed to enable charging of the free surface of the thermoplastic layer when desired, to provide even greater sensitivity.

For effecting a read-out of a recorded structure in accordance with the invention, a schlieren or phase-contrast optics may be provided, disposed to receive reflected optical radiation impacting the recorded structure, a partially transmissive reflector being disposed between the optics and the recorded structure for directing optical radiation on such structure while at the same time, permitting radiation reflected from such structure to pass through the reflector to the optics.

BRIEF DESCRIPTION OF THE DRAWINGS

Referring to the drawings, in which like reference characters indicate like or corresponding elements.

DETAILED DESCRIPTION OF THE INVENTION

Figure 1:
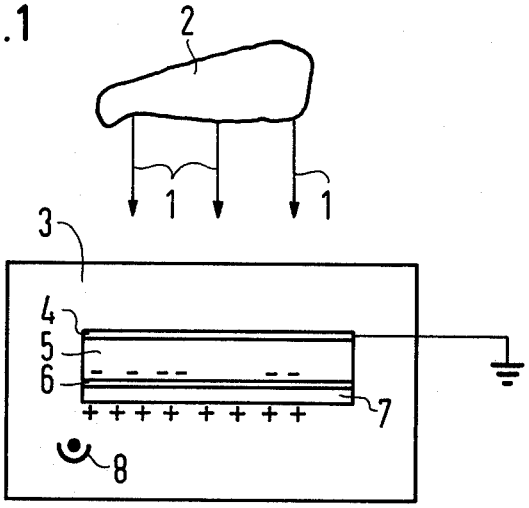
FIG. 1 is a semi-diagrammatic figure schematically illustrating a device in accordance with the invention during recording thereof.

Referring to FIG. 1, the reference numeral 1 designates the X-rays which are to be recorded and which have passed through an object 2. Disposed in a housing 3 is a layer 5 of amorphous selenium having a thickness, for example, of 150 to 300 $\mu$ and having a high dark resistance of over $10^{15}$ ohm/cm. Disposed on the upper surface of the selenium layer, as viewed in FIG. 1, is an electrode, while disposed at the opposite side of the selenium layer is a dielectric layer 6 which is interposed between a thermoplastic layer 7 and the selenium layer 5. Also disposed in the housing 3 adjacent the thermoplastic layer 7 is a movable corona-charge electrode 8, by means of which the exterior free surface of the thermoplastic layer 7 can be provided with a surface charge.

Figure 2:
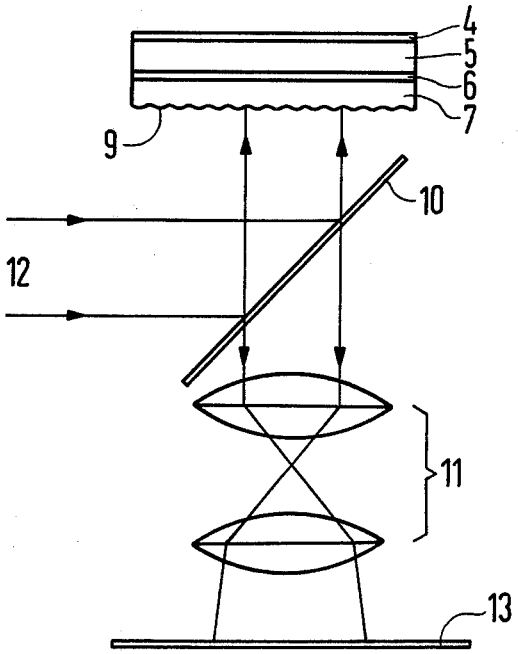
FIG. 2 is a similar figure illustrating the use during reproduction of a recorded structure in accordance with the invention.

Prior to the exposure of the photo-conductive selenium layer with the X-rays, the thermoplastic layer 7 is suitably charged to a few kV, after which the selenium layer is exposed to the X-rays. Each X-ray quantum produces in the selenium a high-speed photo-electron which in turn produces an electron-hole pair, whereby, as a result of the charge flow produced in the selenium, the voltage across the thermoplastic layer increases following exposure to the X-rays 1. The charge distribution arising in the selenium layer 5 produces a corresponding, locally variable voltage distribution in the thermoplastic layer 7 so that during the development of the thermoplastic film a surface relief 9, as illustrated in FIG. 2, is formed. Such development of the thermoplastic layer can be achieved in known manner, for example, by means of the heatable electrode 4 or by infra-red radiation following which the surface relief 9 is fixed by cooling.

In order to increase the sensitivity of the arrangement, during the heating of the thermoplastic layer 7, the electrode 4 can be connected to a high voltage, whereby the thermoplastic layer is disposed in a field of approximately 100V/$\mu$.

In order to further increase the sensitivity, the phase relief produced on the thermoplastic layer can be subsequently reinforced or strengthened, for example, by again charging the thermoplastic layer with the corona-charge, followed by a further development with heat.

Read-out of the X-ray pictures, taken in accordance with the invention, is schematically illustrated in FIG. 2, in which the surface relief 9 is read out by means of an optical radiation 12 directed upon the surface relief 9, for example by means of a partially transmissive reflector 10. Following impacting of the radiation upon the surface 9, it is reflected, with such reflected radiation passing through the reflector 10 and into a schlieren or phase-contrast optics 11 from which it is projected upon a suitable screen 13.

As the X-ray information often is of a very low frequency, and the degree of deformation of the thermoplastic material dependent upon the layer thickness-at higher frequencies, advantageously a grid may be produced on the thermoplastic layer, prior to the exposure thereof with the X-rays, for example by the interference of two laser beams and the subsequent development of the thermoplastic film. Thus, after the exposure to the X-rays and the heating, not only does the surface relief produced by the X-rays arise but also a phase relief produced by the grid structure. As a result of this multiplication of the X-ray picture with a high frequency grid structure, the sensitivity and thus the signal-to-noise ratio of the process can be improved. During read-out, the grid structure can be very easily removed by means of a filter in the schlieren or phase-contrast optics. Another possibility of effecting application of a suitable grid structure, resides in the disposition of an absorption grid for X-rays, i.e., a plate coated with gold, in the X-ray path, ahead of the electrode 4.

The present invention thus enables the recording and reproduction of X-ray pictures of particularly high contrast and in a rapid and economical manner.

Having thus described out invention it will be obvious that although various minor modifications might be suggested by those versed in the art, it should be understood that we wish to embody within the scope of the patent granted hereon all such modifications as reasonably, and properly come within the scope of our contribution to the art.

We claim as our invention:

1. In a device for the recording and reproduction of X-ray pictures, the combination of a layer of amorphous selenium disposed in a housing, the selenium layer being carried by a thermoplastic disposed at one side of the selenium layer, an electrode disposed at the other side of the selenium layer on the free surface thereof, at which side the X-rays impact the device, an additional dielectric layer disposed between said selenium layer and said thermoplastic layer, forming a dielectric reflector, and a movable corona-charge electrode disposed adjacent the thermoplastic layer for charging the free surface of the latter.

2. A device according to claim 1, comprising in further combination, for the read-out of the structure, a schlieren-optic, disposed to receive optical radiation reflected from a previously recorded structure, and a partially transmissive reflector disposed between such recorded structure and said optic, arranged to direct optical radiation on said recorded structure and to pass radiation reflected from the latter to said optic for focusing thereof upon a viewing screen.

3. A device according to claim 1, comprising in further combination, for the read-out of the structure, a phase-contrast-optic, disposed to receive optical radiation reflected from a previously recorded structure, and a partially transmissive reflector disposed between such recorded structure and said optic, arranged to direct optical radiation on said recorded structure and to pass radiation reflected from the latter to said optic for focusing thereof upon a viewing screen.

4. A device according to claim 1, wherein said electrode comprises a heatable layer by means of which the thermoplastic layer may to heated to a deformable state.

5. A method of recording and reproducing X-ray pictures, utilizing a recording structure comprising a layer of amorphous selenium carried by a thermoplastic layer at one side of the selenium layer, the latter having an electrode at the other side of the selenium layer, comprising the steps of charging the thermoplastic layer prior to exposure to a few kV, by means of a corona discharge, exposing the charged structure by directing X-rays on the electrode side of said structure, following their passage through the object involved, developing the exposed thermoplastic layer by the application of heat thereto, to form a surface relief on such layer, and fixing the same by cooling, and subjecting the thermoplastic layer, following developing, with a corona-discharge to again charge the same, and subjecting the structure so charged to a further development by the application of heat thereto.

6. A method according to claim 5, wherein said developing is effected by heating the electrode of said structure.

7. A method according to claim 5, comprising the additional step of applying a voltage to the electrode, during heating of the structure, whereby the thermoplastic layer lies in a field of approximately $100V/\mu$, to increase the sensitivity of the structure.

8. A method according to claim 5, comprising reading out the X-ray pictures so taken, by impacting the surface relief on the structure with optical radiation and focusing the reflected radiation therefrom upon a viewing screen.

9. A method according to claim 5, wherein said developing is effected by subjecting the structure to infrared radiation.

* * * * *